US006856222B1

(12) United States Patent
Forck

(10) Patent No.: US 6,856,222 B1
(45) Date of Patent: Feb. 15, 2005

(54) BIARMATURE SOLENOID

(75) Inventor: Glen F Forck, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 359 days.

(21) Appl. No.: 09/944,669

(22) Filed: Aug. 31, 2001

(51) Int. Cl.[7] ..... H01F 7/08
(52) U.S. Cl. ..... 335/265; 335/281
(58) Field of Search ..... 335/255, 259, 335/265, 267, 281; 239/585.1–585.5

(56) References Cited

U.S. PATENT DOCUMENTS

| | | | | |
|---|---|---|---|---|
| 731,741 | A | * 6/1903 | Baxter, Jr. | 335/265 |
| 4,065,096 | A | 12/1977 | Frantz et al. | |
| 4,514,710 | A | 4/1985 | Conrad | |
| 4,606,502 | A | 8/1986 | Naschberger | |
| 4,770,389 | A | 9/1988 | Bodine et al. | |
| 4,930,541 | A | 6/1990 | Solberg | |
| 4,948,090 | A | 8/1990 | Chen | |
| 5,069,422 | A | 12/1991 | Kawamura | |
| 5,197,508 | A | 3/1993 | Gottling et al. | |
| 5,251,659 | A | 10/1993 | Sturman et al. | |
| 5,445,189 | A | 8/1995 | Yamamuro | |
| 5,515,818 | A | 5/1996 | Born | |
| 5,717,372 | A | 2/1998 | Cannon et al. | |
| 5,915,624 | A | 6/1999 | Coldren et al. | |
| 5,984,210 | A | 11/1999 | Forck et al. | |
| 6,267,306 | B1 | * 7/2001 | Phillips et al. | 239/585.1 |

FOREIGN PATENT DOCUMENTS

| | | |
|---|---|---|
| EP | 0913573 | 5/1999 |
| EP | 0987431 | 3/2000 |

* cited by examiner

*Primary Examiner*—Ramon M. Barrera
(74) *Attorney, Agent, or Firm*—William E McCracken; Steve D Lundquist; Michael B McNeil

(57) ABSTRACT

A solenoid includes first and second armatures disposed on either side of a solenoid core. The core includes first and second sets of legs disposed on opposite sides of a central member. A drive circuit provides a first current level to cause flux to flow in a first path through the core and thereby move the first armature without substantially moving the second armature. The drive circuit can provide a second current level greater than the first current level to saturate the first path and thereby redirect flux into a second core path to move the second armature.

19 Claims, 5 Drawing Sheets

BIARMATURE SOLENOID

TECHNICAL FIELD

The present invention relates generally to solenoids, and more particularly to a solenoid as an actuating element in a fuel injector.

BACKGROUND ART

Fuel injected engines employ fuel injectors, each of which delivers a metered quantity of fuel to an associated engine cylinder during each engine cycle. Prior fuel injectors were of the mechanically or hydraulically actuated type with either mechanical or hydraulic control of fuel delivery. More recently, electronically controlled fuel injectors have been developed. In the case of an electronic unit injector, fuel is supplied to the injector by a transfer pump. The injector includes a plunger which is movable by a cam-driven rocker arm to compress the fuel delivered by the transfer pump to a high pressure. An electrically operated mechanism either carried outside the injector body or disposed within the injector proper is then actuated to cause the fuel delivery to the associated engine cylinder.

The injector may include a valving mechanism comprising a spring-loaded spill valve and a spring-loaded direct operated check (DOC) valve wherein the former is operated to circulate fuel through the injector for cooling, to control injection pressure and to reduce the back pressure exerted by the injector plunger on the cam following injection. However, the need to separately control two valves leads to the requirement for two separate solenoids to control the valves. Besides adding to the overall cost of the injector, the need for two solenoids undesirably increases component count and undesirably increases the overall size of the injector and/or decreases the space available inside the injector for other components.

The electromagnetic force exerted by a solenoid coil increases as the air gap length of the solenoid is reduced. Variability in the air gap length due to assembly tolerances causes a force variability from solenoid-to-solenoid even if current is carefully controlled. This variability can be accommodated in fuel injectors of the foregoing type by selecting spill valve and DOC valve springs and coil current magnitudes which are large enough to work for all cases. However, this method undesirably leads to higher spring loads and electrical currents then would otherwise be needed if no variability existed in the solenoid characteristics.

SUMMARY OF THE INVENTION

BEST MODE FOR CARRYING OUT THE INVENTION

Figure 1:
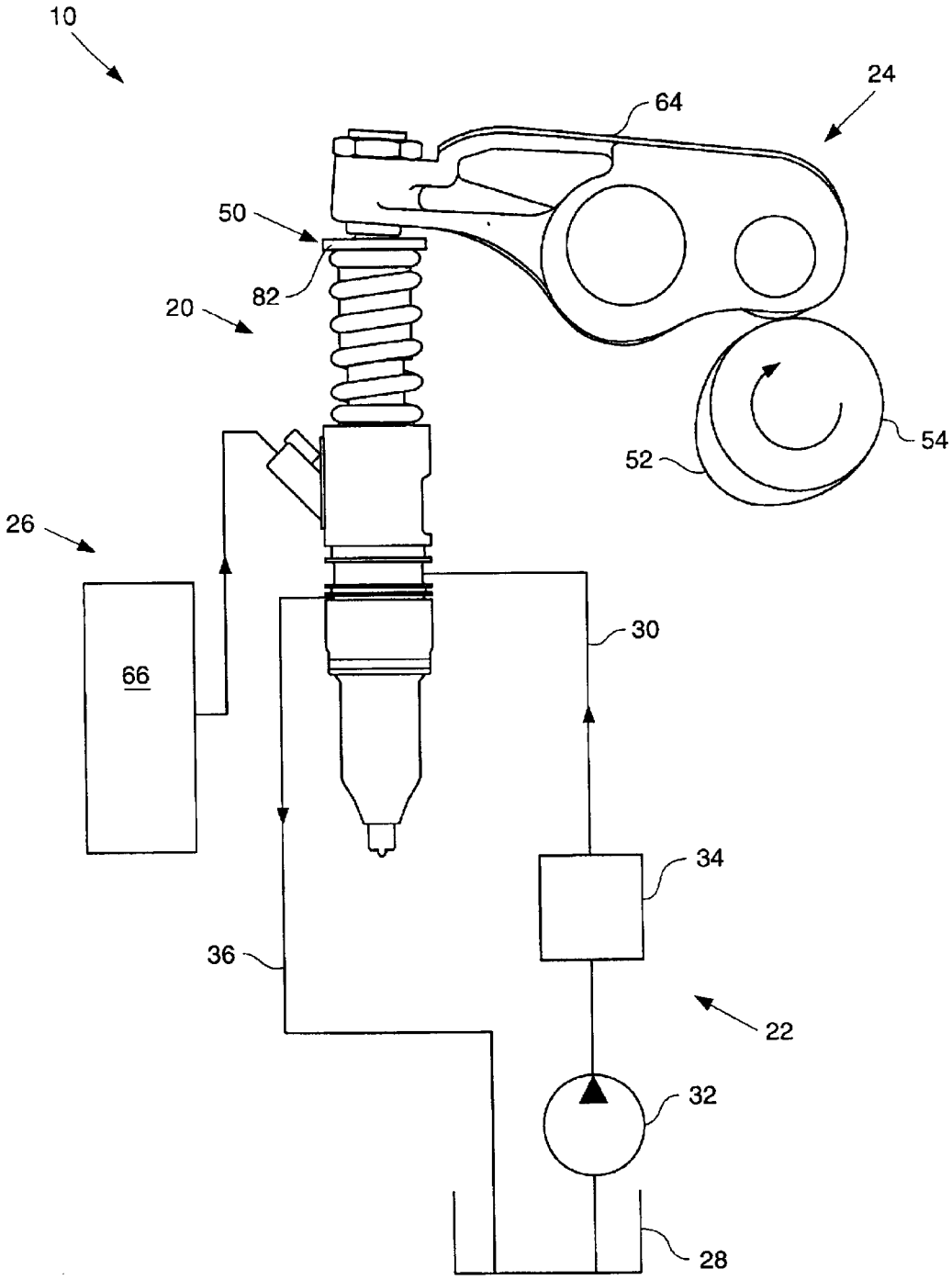
FIG. 1 is a diagrammatic elevational view of an embodiment of the present invention showing a fuel injector, a cam shaft and a rocker arm and further illustrating a block diagram of a transfer pump and a drive circuit for controlling the fuel injector.

Referring to FIG. 1, a portion of a fuel system 10 is shown;

which is adapted for use in a direct-injection diesel-cycle reciprocating internal combustion engine. However, it should be understood that the present invention is also applicable to other types of combustion engines, such as rotary engines or modified-cycle engines, and that the engine may contain one or more engine combustion chambers or cylinders 12 (not shown). The engine has at least one cylinder head 14 (not shown) wherein each cylinder head 14 defines one or more separate injector bores, 16 (not shown)each of which receives a fuel injector 20 according to the present invention.

The fuel system 10 further includes an apparatus 22 for supplying fuel to each fuel injector 20, an apparatus 24 for causing each fuel injector 20 to pressurize fuel and an apparatus 26 for electronically controlling each fuel injector 20.

The fuel supplying apparatus 22 preferably includes a fuel tank 28, a fuel supply passage 30 arranged in fluid communication between the fuel tank 28 and the injector 20, a relatively low pressure fuel transfer pump 32, one or more fuel filters 34 and a fuel drain passage 36 arranged in fluid communication between the fuel injector 20 and the fuel tank 28. If desired, fuel passages 18 (not shown) may be disposed in the head of the engine in fluid communication with the fuel injector 20 and one or both of the fuel supply passage 30 and fuel drain 36.

The apparatus 24 may be any mechanically actuated device or hydraulically actuated device. For example, a cam could be used to push a piston (described below) or high pressure actuation fluid could be controlled electronically to actuate the piston. In the embodiment shown, a tappet and plunger assembly 50 associated with the fuel injector 20 is mechanically actuated indirectly or directly by a cam lobe 52 of an engine-driven cam shaft 54. The cam lobe 52 drives a pivoting rocker arm assembly 64 which in turn reciprocates the tappet and plunger assembly 50. Alternatively, a push rod (not shown) may be positioned between the cam lobe 52 and the rocker arm assembly 64.

The electronic controlling apparatus 26 preferably includes an electronic control module (ECM) 66 which controls: (1) fuel injection timing; (2) total fuel injection quantity during an injection cycle; (3) the number of separate injection segments during each injection cycle; (4) the time interval(s) between the injection segments; (5) the fuel quantity delivered during each injection segment of each injection cycle; and (6) the injection pressure.

Preferably, each fuel injector 20 is a unit fuel injector which includes in a single housing apparatus for both pressurizing fuel to a high level (for example, 207 MPa (30,000 p.s.i.)) and injecting the pressurized fuel into an associated cylinder 12. Although shown as a unitized fuel injector 20, the injector could alternatively be of a modular construction wherein the fuel injection apparatus is separate from the fuel pressurization apparatus 24.

Figure 2:
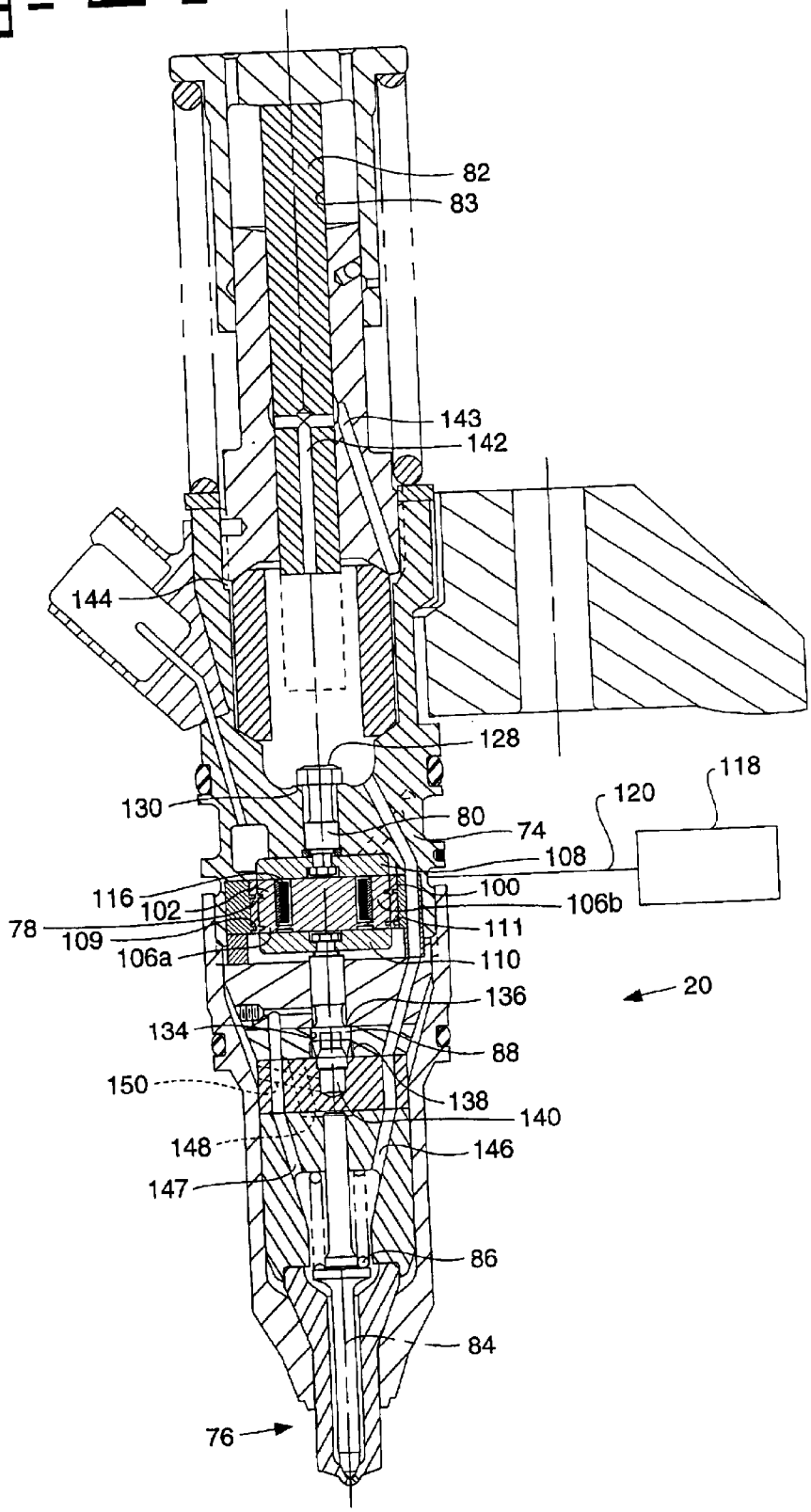
FIG. 2 is a diagrammatic sectional view of the fuel injector of FIG. 1.
Figure 3:
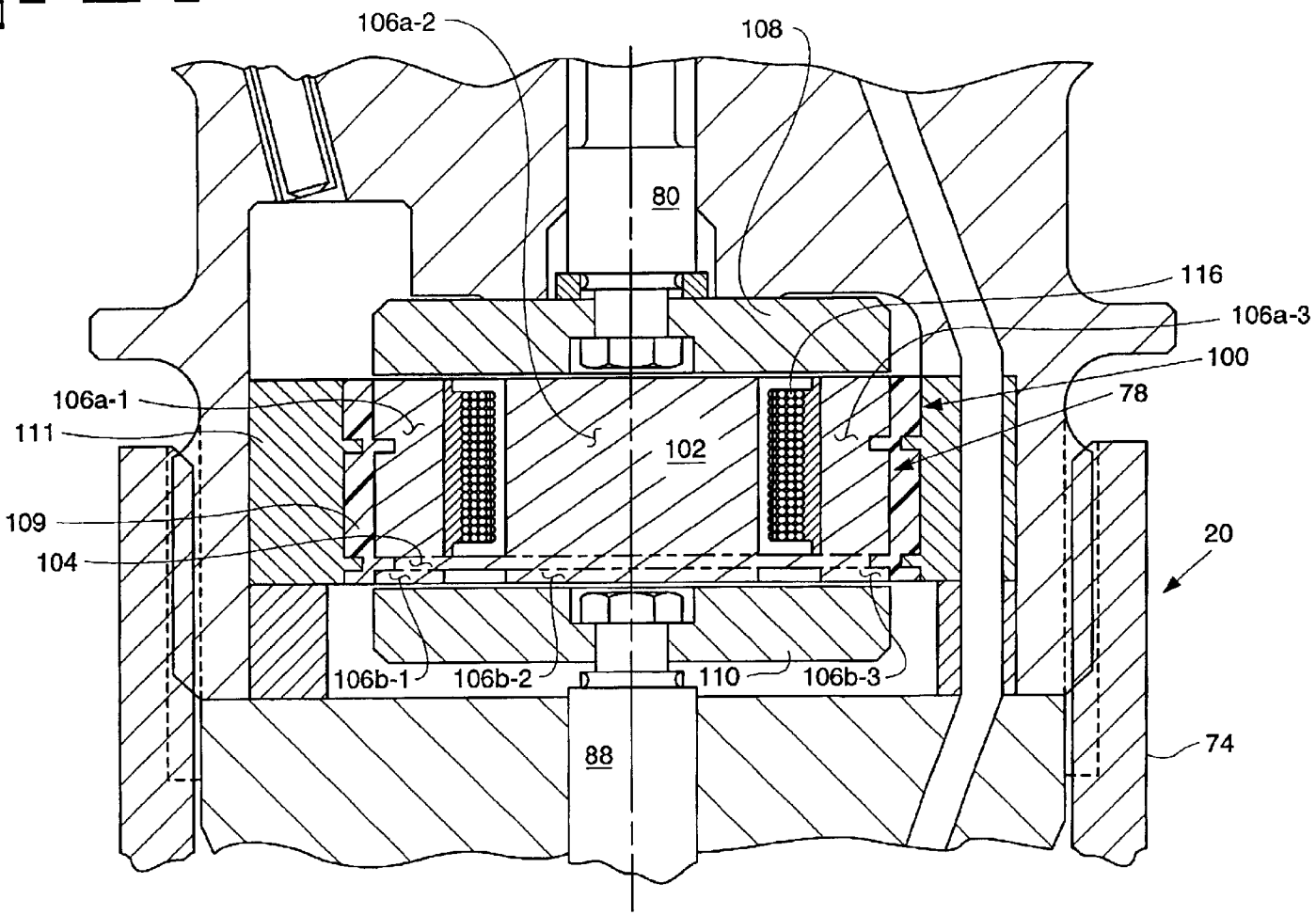
FIG. 3 is an enlarged diagrammatic, fragmentary sectional view illustrating the solenoid of FIG. 2 in greater detail.

Referring now to FIGS. 2 and 3, the fuel injector 20 includes a case 74, a nozzle portion 76, an electrical actuator 78, a spill valve 80, a spill valve spring (not shown), a plunger 82 disposed in a plunger cavity 83, a check 84, a check spring 86 and a direct operated check (DOC) valve 88.

The electrical actuator 78 includes a solenoid 100 for controlling the spill valve 80, and DOC valve 88. The solenoid 100 includes a coil 116 and a core or stator 102 of magnetic (i.e., high permeability) material having a central member 104 and first and second sets of legs **106*a*, 106*b* disposed on opposite sides of the central member 104. The central member 104 is defined as the band of material running horizontally in FIG. 3 between the legs 106*a*** and

106*b*. (It should be noted that the central member 104 is not a separate "piece". The central member is merely identifying the horizontal portion of the stator 102 from which the legs 106*a* and 106*b* protrude. Additionally, the central member 104 connects the legs from each set 106*a* and 106*b*.)

The solenoid 100 further includes first and second armatures 108, 110, respectively, an intermediate member 109 fabricated of plastic or other suitable material surrounding the core 102 and a carrier 111 made of metal or any other suitable material. Preferably, although not necessarily, the core 102 and the armatures 108 and 110 are rectangular or square in overall shape when viewed from elevationally above or below (when oriented as depicted in FIGS. 2 and 3) and the carrier 111 has an annular shape when similarly viewed. Also preferably, the intermediate member is secured to the carrier 111 and the core 102 and has a circular outer surface and rectangular inner surface so as to fill the space between the core 102 and the carrier 111 and provide support for the core 102.

Each set of legs 106*a* and 106*b* includes at least two, and preferably three legs 106*a*-1, 106*a*-2, 106*a*-3 and 106*b*-1, 106*b*-2, 106*b*-3, respectively. Further, the central member 104 and the legs 106*a*-1, 106*a*-2, and 106*a*-3, 106*b*-1, 106*b*-2 and 106*b*-3 are preferably (although not necessarily) linear in shape (i.e., comprise straight sections), are rectangular in cross-section and may have substantially equal cross-sectional sizes. Also, preferably, the legs 106*a*-1, 106*a*-3 are all of a first length whereas the legs 106*b*-1, 106*b*-2 and 106*b*-3 are all of a second length substantially shorter than the first length. If desired, the legs 106*a*-1, 106*a*-2, 106*a*-3, 106*b*-1, 106*b*-2 and 106*b*-3 may be of different shapes and sizes, as noted in greater detail hereinafter.

Figure 5:
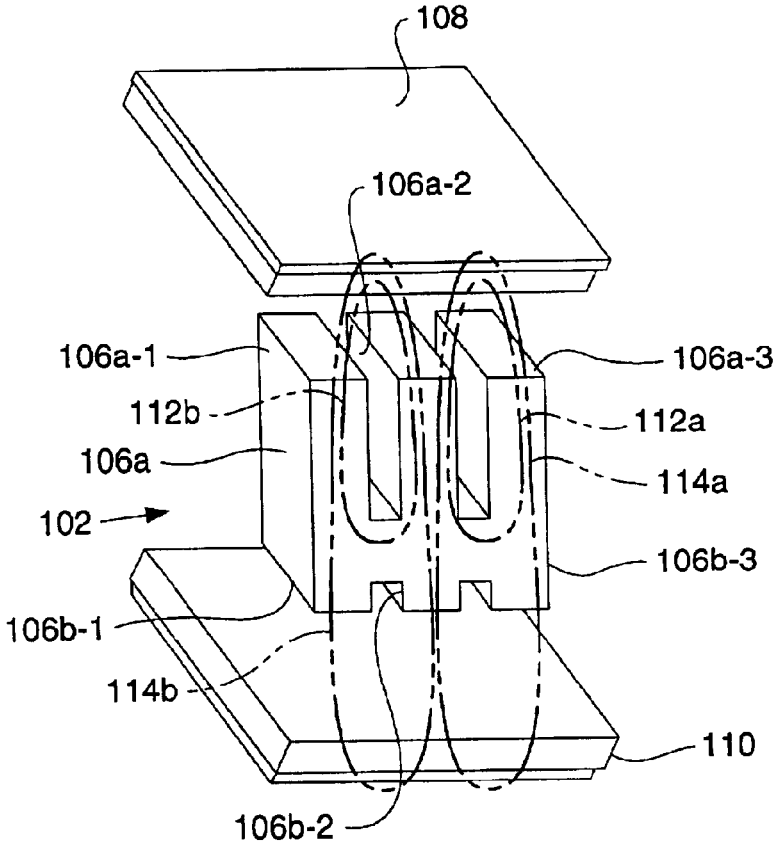
FIG. 5 is a diagrammatic perspective view illustrating the magnetic circuits in the solenoid of FIG. 2.

Referring also to FIG. 5, the legs 106*a*-1 106*a*-2, 106*a*-3, and the first armature 108 together define a first magnetic circuit wherein magnetic flux can flow in paths 112*a* and 112*b* through the leg 106*a*-2, the first armature 108, and the legs 106*a*-1 and 106*a*-3. In addition a second magnetic circuit is defined whereby magnetic flux can flow in paths 114*a* and 114*b*. The path 114*a* extends through the legs 106*a*-2, 106*a*-3, 106*b*-2 and 106*b*-3 and through both armatures 108 and 110. The path 114*b* extends through the legs 106*a*-1, 106*a*-2, 106*b*-1 and 106*b*-2 and through both armatures 108 and 110.

A solenoid coil 116 is connected to a drive circuit 118 (FIG. 2) by conductor 120. The solenoid coil 116 is disposed about a portion of at least one of the first and second magnetic circuits 112 or 114. In the preferred embodiment, the solenoid coil 116 is wound about the leg 106*a*-2, although the solenoid coil 116 may instead be wound about one or more of the other legs 106*a*-1, 106*a*-3, 106*b*-1, 106*b*-2, or 106*b*-3 if desired.

Figure 4:
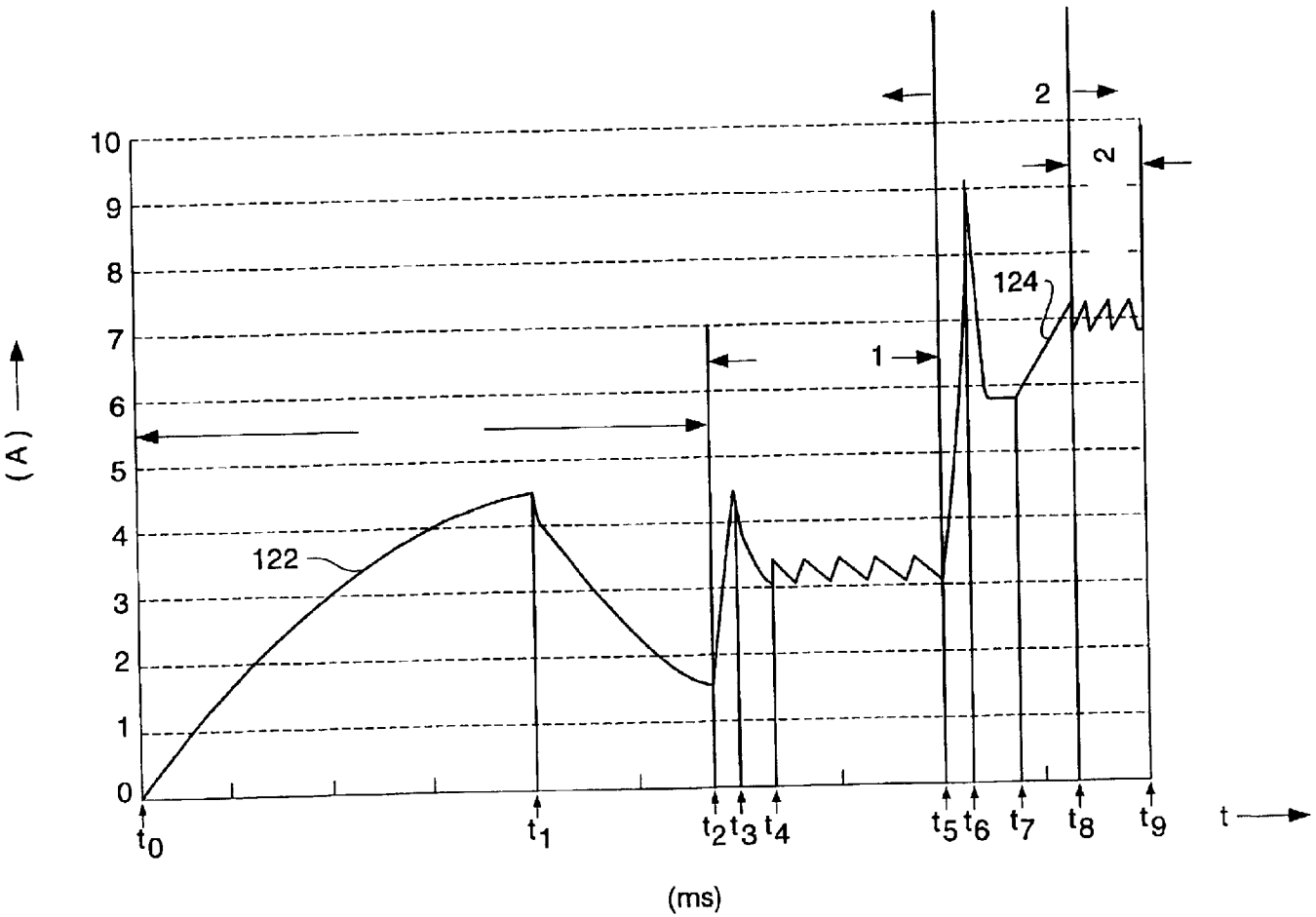
FIG. 4 is a waveform diagram illustrating current waveforms supplied to the solenoid coil of FIGS. 2 and 3.

FIG. 4 illustrates current waveform portions 122, 124 applied by the drive circuit 118 to the solenoid coil 116 during a portion of an injection sequence to accomplish fuel injection. The first current waveform portion 122 is applied between times $t=t_0$ and $t=t_5$ and the second current waveform portion 124 is applied subsequent to the time $t=t_5$. Between time $t=t_0$ and time $t=t_2$, a first pull-in current is provided to the solenoid winding 116 and a first holding current at somewhat reduced levels is thereafter applied between times $t=t_2$ and $t=t_5$. A second pull-in current of generally greater magnitude than the first pull-in current level is applied between times $t=t_5$ and $t=t_8$ and a second holding current generally greater in magnitude than the first holding current level is applied between times $t=t_8$ and $t=t_9$. (It should be noted that the second waveform does not have to have a greater magnitude than the first waveform. The movement of the armatures could be controlled by varying the timing and length of the waveforms because the first magnetic circuit saturates faster than the second.)

INDUSTRIAL APPLICABILITY

At the beginning of an injection sequence, the solenoid coil 116 is unenergized, thereby permitting a spill valve spring (not shown) to open the spill valve 80 such that a spill valve sealing surface 128 is spaced from a spill valve seat 130. Also at this time, a DOC valve spring (also not shown) moves the DOC valve 88 to a position whereby a upper DOC sealing surface 134 is spaced from a upper DOC valve seat 136 and such that a lower DOC sealing surface 138 is in sealing contact with a lower DOC valve seat 140. Under these conditions, and before the plunger 82 is moved downwardly by the engine camshaft from the position shown in FIG. 2, fuel cycles through plunger passage 142, drain passage 143 and second drain passage 144 to drain. Subsequently, the lobe on the cam pushes down on the plunger 82 of the injector 20, taking the plunger passage 142 in the plunger 82 out of fluid communication with the second drain passage 144 so that fuel pressurization can then take place. The current waveform portion 122 is then delivered to the solenoid coil 116 by the drive circuit 118 causing flux to flow through the paths 112*a* and 112*b*. At this time substantially no flux flows through the paths 114*a* and 114*b* owing to the availability of the low reluctance path for flux through the legs 106*a*-2 and 106*b*-2 as contrasted to the high reluctance path across the airgap between the armature 110 and the core 102. The pull-in and holding current levels of the waveform portion 122 and the spill valve spring are selected such that the motive force developed by the first armature 108 exceeds the spill valve spring force. Consequently, the first armature 108 moves downwardly to reduce the size of an upper airgap between the armature 108 and the core 102 and forces the spill valve sealing surface 128 into sealing engagement with the spill valve seat 130 to close the spill valve 80. Also during this time, the DOC valve 88 remains in the previously described condition. Fluid pressurized by subsequent downward movement of the plunger 82 is delivered to a high pressure fuel passage 146 leading to a bottom end of the check 84. Pressurized fluid is also delivered to a high pressure fuel DOC passage 147 and a check end passage 148 in fluid communication with an upper end of the check 84. Because the fluid pressures on the ends of the check are balanced, the check remains closed at this time.

The drive circuit 118 thereafter delivers the second current waveform portion 124 to the solenoid coil 116. Preferably, this increased current level develops sufficient flux to saturate the legs 106*a*-2 and 106*b*-2. As a result of such saturation, flux in excess of the saturation level of the legs 106*a*-2 and 106*b*-2 is redirected into the paths 114*a* and 114*b*, causing a force to be exerted on the second armature 110 which exceeds the spring force exerted by the DOC spring. As a result, the armature 110 moves upwardly to reduce the size of the airgap between the armature 110 and the core 102. This upward movement is transmitted to the valve 88 to cause the valve 88 also to move upwardly such that the upper DOC sealing surface 134 is moved into sealing contact with the upper DOC valve seat 136. In addition, the lower DOC sealing surface 138 moves out of sealing contact with the lower DOC valve seat 140. The effect of this movement is to isolate the second check end passage 148 from the high pressure fluid and to permit fluid communication between the check end passage 148 and a 3rd drain passage 150 in fluid communication with drain (the connection between the passage 150 and drain is not shown in the Figs.). The pressures across the check then become unbalanced, thereby overcoming the check spring preload and driving the check upwardly so that fuel is injected into an associated cylinder.

When injection is to be terminated, the current delivered to the solenoid coil 116 may be reduced to the holding level of the first current waveform portion 122 as illustrated in FIG. 4. If desired the current delivered to the solenoid coil 116 may instead be reduced to zero or any other level less than the first holding level. In any case, the DOC valve 88 first moves downwardly, thereby reconnecting the check end passage 148 to the high pressure fuel DOC passage 147. The fluid pressures across the check thus become balanced, allowing the check spring 86 and the load differential across the check to close the check 84. The current may then be reduced to zero or any other level less than the first holding level (if it has not been already so reduced). Regardless of whether the applied current is immediately dropped to the first holding level or to a level less than the first holding level, the spill valve spring opens the spill valve 80 after the DOC spring moves the DOC valve 88 downwardly.

If desired, the solenoid coil may receive more than two current waveform portions to cause the armatures to move to any number of positions (not just two), and thereby operate one or more valves or other movable elements.

Still further, multiple or split injections per injection cycle can be accomplished by supplying suitable waveform portions to the solenoid coil 116. For example, the first and second waveform portions 122, 124 may be supplied to the coil 116 to accomplish a pilot or first injection. Immediately thereafter, the current may be reduced to the first holding current level and then increased again to the second pull-in and second holding levels to accomplish a second or main injection. Alternatively, the pilot and main injections may be accomplished by initially applying the waveform portions 122 and 124 to the solenoid coil 116 and then repeating application of the portions 122 and 124 to the coil 116. The durations of the pilot and main injections (and, hence, the quantity of fuel delivered during each injection) are determined by the durations of the second holding levels in the waveform portions 124. Of course, the waveform shapes shown in FIG. 4 may be otherwise varied as necessary or desirable to obtain a suitable injection response or other characteristic.

As noted previously, the sizes and shapes of the legs 106*a*-1, 106*a*-2, 106*a*-3, 106*b*-1, 106*b*-2 and 106*b*-3 and the central member 104 can be varied as necessary to obtain proper operation. For example, the legs 106*b*-1, 106*b*2 and 106*b*-3 can be made larger (or smaller) in cross-section, longer (or shorter) in length, different in shape, etc. than that shown in the Figs. and/or as compared to the legs 106*a*-1, 106*a*-2 and 106*a*-3. Additionally, the airgap lengths may be made substantially equal (as shown) or may be unequal as needed to obtain proper operation.

Because only a single solenoid is needed to operate the two valves 80, 88, as opposed to two solenoids to accomplish this function, size and weight can be reduced. Further, the sizes of the spill valve and DOC valve springs can be reduced to substantially the minimum sizes required to operate reliably the valves 80, 88, as opposed to the use of substantially larger springs of differing spring constants to obtain the dual valve operation as in other injectors. In addition, sliding air gaps are eliminated, thereby permitting a lower cost stamped solenoid with flat armatures to be used.

Other aspects of the invention may be obtained from a reading of the specification, drawings and claims.

List of Elements

File: 96-451
10 Fuel system
12 Cylinder
14 Cylinder head
16 Injector bore
18 Fuel passage
20 Fuel injector
22 Fuel supplying apparatus
24 Fuel pressurization apparatus
26 Electronic controlling apparatus
28 Fuel tank
30 Fuel supply passage
32 Transfer pump
34 Fuel filter
36 Fuel drain passage
50 Tappet and plunger assembly
52 Cam lobe
54 Cam shaft
64 Rocker arm assembly
66 ECM
74 Case
76 Nozzle portion
78 Electrical actuator
80 Spill valve
81 Spill valve spring
82 Plunger
83 Plunger cavity
84 Check
86 Check spring
88 Direct operated check valve
100 Solenoid
102 Stator
104 Central member
106*a* 1st set of legs
106*b* 2nd set of legs
108 First armature
109 Intermediate member
110 Second armature
111 Carrier
112 1st magnetic circuit
114 2nd magnetic circuit
116 Solenoid coil
118 Drive circuit
120 Conduit
122 Waveform
124 2nd Waveform
128 Spill valve sealing surface
130 Spill valve seat
134 Upper DOC sealing surface
136 Upper DOC valve seat
138 Lower DOC sealing surface
140 Lower DOC valve seat
142 Plunger passage
143 Drain passage
144 2nd Drain passage
146 High pressure fuel passage
147 High pressure fuel DOC passage
148 Check end passage
150 3 rd Drain passage

What is claimed is:

1. A solenoid, comprising:

first and second armatures each being constructed of a magnetic material;

a core of magnetic material forming a first magnetic circuit with the first armature and a second magnetic circuit with the second armature wherein the first and second magnetic circuits have a common path to the two circuits and wherein each circuit has a exclusive path to the circuit; and a solenoid coil disposed about a portion of at least one of the circuits and being positioned between the first and second armatures.

2. The solenoid as set forth in claim 1, in combination with a drive circuit coupled to the solenoid coil.

3. The solenoid as set forth in claim 2, wherein the drive circuit delivers a first current level to the solenoid coil to move the first armature without substantially moving the second armature and further delivers a second current level greater than the first current level to saturate the path of the first magnetic circuit and cause the solenoid coil to move the second armature.

4. The solenoid as set forth in claim 1, wherein the core of magnetic material includes a first pair of legs disposed on one side of a central member and a second pair of legs disposed on another side of the central member.

5. The solenoid as set forth in claim 4, wherein the legs have substantially equal cross-sectional sizes.

6. The solenoid of claim 1, wherein the core of magnetic material includes a first set of three legs disposed on one side of a central member and a second set of three legs disposed on a second side of a central member.

7. A solenoid, comprising:

first and second armatures each being constructed of a magnetic material;

a core of magnetic material forming a first magnetic circuit with the first armature and a second magnetic circuit with the second armature wherein the first and second magnetic circuits have a common path to the two circuits and wherein each circuit has a exclusive path to the circuit;

a solenoid coil disposed about a portion of at least one of the circuits wherein the core of magnetic material includes a first pair of legs disposed on one side of a central member and a second pair of legs disposed on another side of the central member; and wherein the legs have a linear shape.

8. A solenoid, comprising:

first and second armatures each being constructed of a magnetic material;

a core of magnetic material forming a first magnetic circuit with the first armature and a second magnetic circuit with the second armature wherein the first and second magnetic circuits have a common path to the two circuits and wherein each circuit has a exclusive path to the circuit;

a solenoid coil disposed about a portion of at least one of the circuits wherein the core of magnetic material includes a first pair of legs disposed on one side of a central member and a second pair of legs disposed on another side of the central member; and wherein the first pair of legs and the second pair of legs have substantially unequal lengths.

9. A solenoid, comprising:

first and second armatures each being constructed of a magnetic material;

a core of magnetic material forming a first magnetic circuit with the first armature and a second magnetic circuit with the second armature wherein the first and second magnetic circuits have a common path to the two circuits and wherein each circuit has a exclusive path to the circuit;

a solenoid coil disposed about a portion of at least one of the circuits, wherein the core of magnetic material includes a first set of three legs disposed on one side of a central member and a second set of three legs disposed on a second side of a central member; and wherein the solenoid coil is disposed about a middle leg of the first set of three legs.

10. A solenoid, comprising:

first and second armatures each of magnetic material;

a solenoid core of magnetic material including a central member, first, second and third legs disposed on a first side of the central member such that the second leg is between the first and third legs and fourth, fifth, and sixth legs disposed on a second side of the central member such that the fifth leg is between the fourth and sixth legs, wherein the first armature, the first, second, and third legs comprise a first magnetic circuit and the first, second, third, fourth, fifth and sixth legs and the first and second armatures comprise a second magnetic circuit; and a solenoid coil disposed about a portion of at least one of the first and second magnetic circuits.

11. The solenoid as set forth in claim 10, in combination with a drive circuit coupled to the solenoid coil.

12. The solenoid as set forth in claim 11, wherein the drive circuit delivers a first current level to the solenoid coil to move the first armature without substantially moving the second armature and further delivers a second current level greater than the first current level to the solenoid coil to saturate the second and fifth legs and direct flux into the second magnetic circuit to move the second armature.

13. The solenoid as set forth claim 12, wherein the first, second, third, fourth, fifth and sixth legs are linear in shape and wherein the first, second and third legs have a first length and the fourth, fifth and sixth legs have a second length substantially unequal to the first length.

14. The solenoid as set forth in claim 10, wherein the solenoid coil is disposed about the second leg only.

15. The solenoid as set forth in claim 10, wherein the first armature forms a first airgap with the first, second and third legs when the solenoid coil is unenergized and wherein the second armature forms a second airgap with the fourth, fifth and sixth legs when the solenoid coil is unenergized and wherein the first and second airgaps are of equal lengths.

16. A method of operating a solenoid that includes first and second armatures each of magnetic material, each located on opposite sides a magnetic core, said magnetic core having a central member, a first set of legs disposed on one side of said central member and a second set of legs disposed on an opposite side of said central member, a solenoid coil, said coil connected to a drive circuit, and a first magnetic circuit formed between said first armature and said first set of legs and a second magnetic circuit formed by said first and second armatures and said first and second sets of legs; the method comprising:

providing a first current level to said coil to activate said first magnetic circuit and move said first armature without substantially moving said second armature; and providing a second current level to said coil to saturate said first magnetic circuit and activate said second magnetic circuit and move said second armature.

17. The method of claim 16 wherein said second current level is greater than said first current level.

18. A solenoid comprising:

a solenoid core of magnetic material having a central member, a first set of a plurality of legs located on one side of said central member and a second set of a plurality of legs located on the opposite side of said central member, and a coil wrapped around at least a portion of one leg from at least one set of the first and second set of legs;

a first armature located on one side of said solenoid core, and a second armature located on an opposite side of said solenoid core; and an electrical energy source being adapted to deliver a first current level to said coil such that a first magnetic circuit is activated, thereby moving said first armature without substantially moving said second armature and a second current level such that a second magnetic circuit is activated, thereby moving said second armature.

19. The solenoid of claim 18 wherein a magnitude of said second waveform is greater than a magnitude of said first waveform.

* * * * *

UNITED STATES PATENT AND TRADEMARK OFFICE

CERTIFICATE OF CORRECTION

PATENT NO. : 6,856,222 B1
DATED : February 15, 2005
INVENTOR(S) : Forck

It is certified that error appears in the above-identified patent and that said Letters Patent is hereby corrected as shown below:

Title page,
Item [73], Assignee, insert the following:
-- Delphi Technologies Inc., Troy, MI (US) --.

Signed and Sealed this

Eleventh Day of October, 2005

JON W. DUDAS
*Director of the United States Patent and Trademark Office*